United States Patent [19]

Davis

[11] 4,278,056

[45] Jul. 14, 1981

[54] TEMPERATURE SENSOR VALVE

[76] Inventor: Bill G. Davis, 516 W. Rancho, Phoenix, Ariz. 85013

[21] Appl. No.: 38,931

[22] Filed: May 14, 1979

[51] Int. Cl.[3] ..... F02B 77/00

[52] U.S. Cl. ..... 123/198 D; 123/41.15

[58] Field of Search ..... 123/198 D, 198 DB, 41.15, 123/198 DC; 236/98

[56] References Cited

U.S. PATENT DOCUMENTS

| | | | |
|---|---|---|---|
| 3,202,143 | 8/1965 | Goodwin | 123/198 DB X |
| 4,067,348 | 1/1978 | Davis | 123/198 DB X |
| 4,126,114 | 11/1978 | Davis | 123/198 D |

*Primary Examiner*—Tony M. Argenbright

*Attorney, Agent, or Firm*—Cahill, Sutton & Thomas

[57] ABSTRACT

In a liquid cooled engine or engine-driven accessory having an engine protection device for reducing the engine RPM to a safe level in response to a fluid pressure below an acceptable level, a temperature sensor valve continuously senses the operating temperature of the engine or engine-driven accessory and reduces the fluid pressure below the acceptable level of the engine protection device in response to an over-temperature condition or in response to a partial or complete loss of the liquid coolant. The temperature sensor valve includes a temperature sensing tip which is coupled to the housing of the engine or engine-driven accessory. A heat receiving section of the temperature sensing tip receives heat from the housing and a heat dissipating section which protrudes into the coolant filled chamber transfers heat received from the heat receiving section into the coolant. The temperature sensing tip further includes an internal, longitudinally extending receptacle filled with a temperature responsive material which expands and contracts in response to the temperature of the temperature sensing tip. A partial or complete loss of coolant or an over-temperature condition will cause the temperature responsive material to expand and open a path in the temperature sensor valve which reduces the fluid pressure sensed by the engine protection device below the acceptable level and actuates the engine protection device to reduce the engine RPM to a safe level.

5 Claims, 4 Drawing Figures

FIG. 1
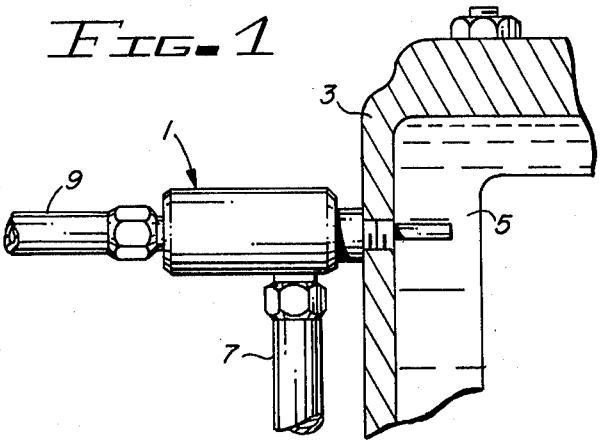
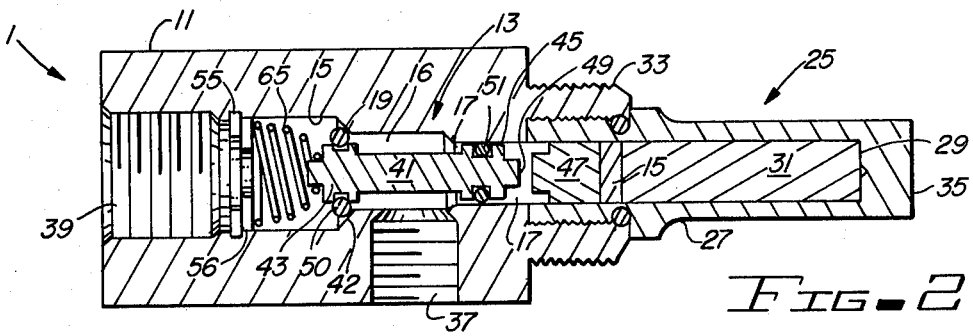
FIG. 2
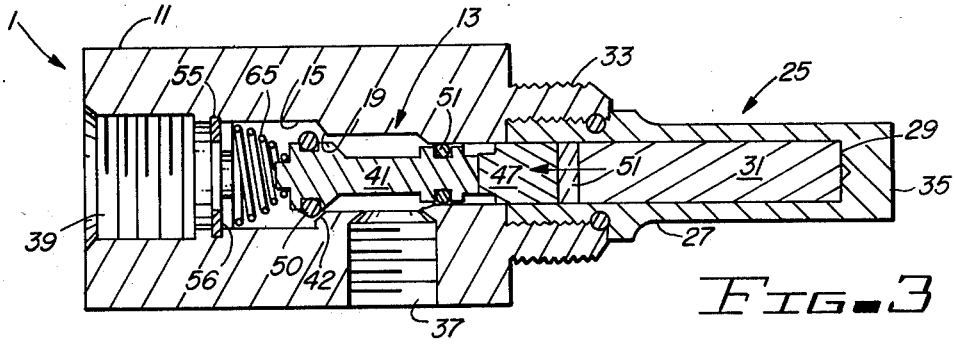
FIG. 3
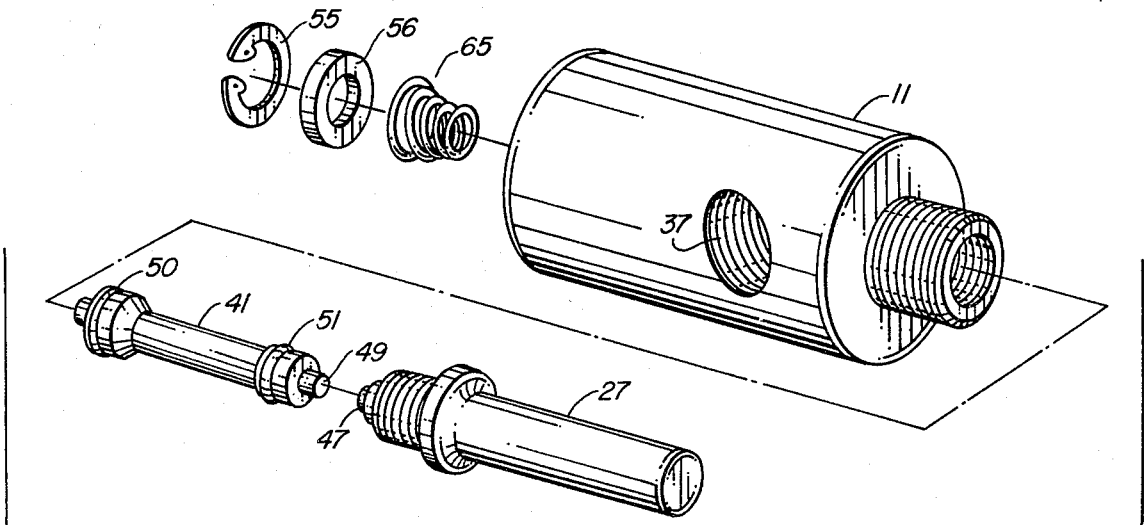
FIG. 4

TEMPERATURE SENSOR VALVE

BACKGROUND OF THE INVENTION

1. Field of the Invention

This invention relates to valves, and more particularly, to temperature sensor valves in an engine or engine-driven accessory for altering the pressure of a fluid in response to at least a partial loss of coolant or an over-temperature condition.

2. Description of the Prior Art

In the operation of internal combustion engines, it is frequently desirable to provide protection means for automatically shutting off the engine or at least reducting its operating RPM to a safe level when certain conditions occur which would be detrimental to the engine or to an engine-driven accessory, such as an air compressor, hydraulic pump or transmission. To provide such protection, devices have been designed which are responsive to the temperature of the engine or accessory coolant. When the temperature of the coolant exceeds a predetermined value, these devices actuate an engine protection device such as a fuel shut-off valve which shuts off the fuel supply to the engine. A device of this type is disclosed in a patent issued to Goodwin (U.S. Pat. No. 3,302,143). However, devices such as these sense only the temperature of the engine coolant, whereas engine damage can occur when engine coolant is lost. Upon loss of engine coolant, the Goodwin apparatus will be ineffective since it will sense a low temperature because the coolant is no longer in contact with its temperature sensing probe. To protect an engine from damage due to loss of coolant, a separate coolant level sensor must be provided to operate in conjunction with the Goodwin device to prevent damage due to an engine over-temperature condition resulting from loss of engine coolant. The requirement for a separate coolant temperature sensor and a coolant level sensor substantially increases the cost of installation of these devices since each device must be separately installed on the engine and coupled to a separate engine protection means for shutting down the engine when a loss of coolant occurs or when an engine over-temperature condition exists.

A device which overcomes the above difficulty is disclosed in U.S. Pat. No. 4,126,114. In the latter patent, a temperature sensor is provided that senses the temperature of the engine block and which obtains heat from the engine block and transfers the heat to the engine coolant. Thus, an over heated temperature condition and/or the absence of an engine coolant will result in remedial action. In the type of valve described in the latter patent, oil from the engine lubricating system is admitted under pressure to a chamber that is sealed by a movable piston; upon detection of an over-heat condition, the piston is moved to open the chamber to an oil outlet port to thereby immediately reduce oil pressure and permit engine shut-down apparatus to begin the shut-off procedure. The piston operating in the bore is sealed against the bore through the use of O-rings; however, since there are passages communicating with the bore, damage to the O-ring sometimes occurs during assembly of the apparatus. The damage may not readily be apparent upon initial testing and will therefore fail after installation and during subsequent use.

Other types of engine protection devices for preventing damage due to an engine over-temperature conditions are disclosed in the following U.S. Pat. Nos. 3,153,403 (Dobbs), 2,125,066 (Cox), 1,869,429 (King), and 1,838,409 (King).

SUMMARY OF THE INVENTION

It is therefore a primary object of the present invention to provide an improved temperature sensor valve which will actuate an engine protection means to reduce the engine RPM to a safe level when the temperature of the engine block exceeds a predetermined threshold level or when coolant is lost from the engine.

Another object of the present invention is to provide an improved temperature sensor valve which will activate an engine protection means to reduce the engine RPM to a safe level when the temperature of an engine-driven accessory exceeds a predetermined level or when the engine-driven accessory loses a portion of its coolant.

Yet another object of the present invention is to provide an improved temperature sensor valve which is heated by direct contact with the housing of an engine or engine-driven accessory and cooled by the coolant of the engine or engine-driven accessory in order to maintain the temperature of the temperature sensor valve at a predetermined level when the temperature of the engine lies within the normal operating range and when the engine coolant level is maintained at its normal capacity.

Still another object of the present invention is to provide an improved temperature sensor valve which is completely self-contained and mechanically actuated, and which may be manufactured and assembled without damage to internal seals.

Yet another object of the present invention is to provide a temperature sensor valve which as a single moving part.

Briefly stated, and in accordance with one embodiment of the invention, a liquid cooled engine or engine-driven accessory includes engine protection means for reducing the engine RPM to a safe level in response to a fluid pressure below an acceptable level. A temperature sensor valve continuously senses the operating temperature of the engine or engine-driven accessory and reduces the fluid pressure below the acceptable level in response to an over-temperature condition or in response to at least a partial loss of liquid coolant. The main structural element of the temperature sensor valve is a body having a cylindrical bore. A first radially inwardly extending annular seat divides the bore into first and second sections, the second section including an intermediate bore portion having a diameter greater than that of the remainder of the second section. A fluid pressure port communicates with the intermediate bore portion of the second bore section; the pressure port is connected to a source of fluid under pressure such as the pressurized lubricating oil system of a vehicle. A fluid outlet port communicates with the first bore section for providing a low pressure fluid drain path. Temperature sensor means is coupled to the housing of the engine or engine-driven accessory and protrudes into a coolant filled chamber of the engine or engine-driven accessory to receive heat from the housing and to transfer that heat into the coolant. The temperature sensor means includes a temperature sensing tip having an internal, longitudinally extending receptacle. A temperature responsive material is disposed within the receptacle for expanding and contracting in response to the temperature of the temperature sensing tip.

A piston is slidably movable in the bore between a first position and a second position. The piston includes a large diameter element having a face positioned in the intermediate bore section and communicating with the fluid pressure port. The piston further includes a small diameter element having a second face positioned in the second bore section and mechanically communicating with the temperature responsive material.

The piston includes a reduced diameter portion extending between the first and second faces so as to permit the passage of fluid thereabout. The small diameter element having the second face thereon sealingly engages the second bore section through sealing means positioned around the periphery of the small diameter element of the piston. The sealing means prevents the entry of fluid under pressure into the space occupied by the temperature responsive material. Sealing means is also provided about the large diameter element in sealing engagement with the radially inwardly extending annular seat. Spring biasing means exerts a predetermined force on the piston to urge the sealing means on the large diameter element into engagement with the annular seat; when in this position, the piston prevents the flow of fluid from the fluid pressure port to the fluid outlet port. When the piston is in a second position, the sealing means is displaced from the annular seat to thereby provide a fluid path from the fluid pressure port, around the reduced diameter portion of the piston, the intermediate bore portion of the second bore section, past the annular seat and out the fluid outlet port.

An over-temperature condition or loss of liquid coolant causes the temperature responsive material to expand and displace the piston from the first position to the second position for reducing the fluid pressure by opening the path between the fluid pressure port and the fluid outlet port. Opening this path reduces the fluid pressure below the acceptable level of the engine protection means and thereby actuates the engine protection means to reduce the engine RPM to a safe level.

DESCRIPTION OF THE DRAWINGS

The invention is pointed out with particularity in the appended claims. However, other objects and advantages, together with the operation of the invention, may be better understood by reference to the following detailed description taken into connection with the following illustrations wherein:

FIG. 1 is a side elevation view partially in section of the temperature sensor valve of the present invention installed in the block of an internal combustion engine and extending into a coolant filled chamber of the engine.

FIG. 2 is a sectional view of the temperature sensor valve of the present invention in the first position which corresponds to a safe temperature and coolant condition.

FIG. 3 is a sectional view, partially cutaway, of the temperature sensor valve of the present invention in the second position corresponding to an unsafe temperature or coolant condition.

FIG. 4 is an exploded perspective view of the temperature sensor valve of the present invention.

DESCRIPTION OF THE PREFERRED EMBODIMENT

In order to better illustrate the advantages of the invention and its contributions to the art, a preferred hardware embodiment of the invention will now be described in some detail.

Referring to FIG. 1, temperature sensor valve 1 is coupled to the block 3 or some other integral metallic part of an internal combustion engine. A portion of temperature sensor valve 1 protrudes into a coolant filled chamber 5 of internal combustion engine. Coolant filled chamber 5 could be the engine thermostat housing, the coolant jacket or the coolant manifold. The metallic part to which temperature sensor valve 1 is attached cannot be separated from the main body of the engine by a hose or other heat insulator; it must be attached to a metallic portion of the engine where it can receive heat directly transmitted from the engine cylinder head, which is the primary source of engine heat. Oil pressure line 7 transmits oil under pressure from the internal combustion engine oil system to temperature sensor valve 1. Oil return line 9 provides a low pressure oil return path to the crankcase of the engine to drain the oil released by temperature sensor valve 1 when an unsafe temperature or coolant condition exists. Oil pressure line 7 is typically connected to the oil pressure inlet port of an engine protection means such as that described in U.S. Pat. No. 4,067,348 entitled "FUEL SHUT-OFF VALVE".

An engine over-temperature condition or a partial or complete coolant loss will activate temperature sensor valve 1 to open a path between oil pressure line 7 and oil return line 9, thus decreasing the oil pressure sensed by the engine protection means, which can either reduce the engine operating RPM to idle or totally shut off the engine.

Referring now to FIG. 2, temperature sensor valve 1 includes a body 11 having a longitudinally extending cylindrical bore 13. Cylindrical bore 13 is divided into a first section 15 and a second section 17 by a radially inwardly extending annular seat. The second bore section includes an intermediate bore portion 16 having a diameter greater than the remainder of the second bore section 17.

Temperature sensor means 25 is rigidly attached to body 11 and includes a temperature sensing tip 27 having an internal, longitudinally extending receptacle 29 which encloses a temperature responsive material 31.

In the preferred embodiment, temperature responsive material 31 is a medium density polyethylene rod manufactured and sold by Union Carbide under the trademark Polypenco and specifically designated as 6423 Black 9865 Resin. Polypenco rod 31 was selected because it is solid polyethylene material which can be readily ground and cut to length for precisely fitting within receptacle 29. Additionally, the Polypenco rod 31 expands at a very rapid rate between 185° and 235° F., while large temperature excursions above 235° F. and below 185° F. have little physical effect on the rod. While a temperature responsive material 31, such as a Polypenco rod, has been found to be highly advantageous, it has also been found that other polyethylene materials or bee's wax also function satisfactorily.

The temperature sensor valve is threadably attached to engine block 3 for directly receiving heat from the engine and uniformly transmitting that heat along the length of temperature sensing tip 27. Temperature sensing tip 27 further includes heat dissipating portion 35 which protrudes into coolant filled chamber 5 for transferring heat out of temperature sensing tip 27 into the liquid coolant in coolant filled chamber 5.

Oil pressure line 7 is coupled to fluid pressure port 37 for transmitting oil under pressure into the intermediate bore portion 16 of the second bore section 17. Oil return line 9 is coupled to fluid outlet port 39 to provide a low pressure oil return path to the engine crankcase.

A piston 41 includes a large diameter element 43 disposed within first bore section 15. A small diameter element 45 of piston 41 is disposed within second bore section 17. A brass spacer 47 is disposed within receptacle 29 between face 49 and a Teflon spacer 52 which is positioned adjacent to one end of temperature responsive material 31. Teflon spacer 52 provides a positive seal between the walls of receptacle 29 and temperature sensitive material 31 to prevent flow-by or flashing of temperature sensitive material 31 into second bore section 17 due to the elevated temperatures present in temperature sensor means 25 during normal engine operation.

The piston 41 includes a reduced diameter portion 42 that generally corresponds in length to the length of the intermediate bore portion 16. The reduced diameter portion of the piston together with the intermediate bore portion provide a passageway from the fluid pressure port 37 to the first bore section 15 ultimately to the fluid outlet port 39. The large diameter element 43 includes a relatively heat insensitive Teflon O-ring 50 which seats against the inwardly extending annular seat 19 to seal the intermediate bore portion 16 from the bore section 15. The small diameter element 45 is also provided with a relatively heat insensitive Viton O-ring 51 that slidingly engages the second bore section 17. Thus, the piston 41 may assume a first position, such as shown in FIG. 2, wherein the piston 41 is in a first position with the O-ring 50 in sealing engagement with the annular seat 19, or a second position such as that shown in FIG. 3 wherein the piston 41 has been displaced to the left to provide a passage for fluid entering the port 37 through the intermediate bore portion 16 and the bore section 15 to the outlet port 39.

A retaining ring 55 and a spring retainer 56 maintain spring 57 within first bore section 15. FIG. 2 shows piston 41 of temperature sensor valve 1 in the first position which indicates three things: (1) the temperature of engine block 3 is below a predetermined maximum safe value; (2) the temperature of the coolant within coolant filled chamber 5 is below a predetermined maximum safe value; and (3) heat dissipation means 35 is totally surrounded by liquid coolant in coolant filled chamber 5.

If temperature sensor valve 1 is designed to be installed in an engine having a 185° F. normal operating temperature and a 265° F. maximum permissible temperature, then piston 41 will be in the first position shown in FIG. 2 when the engine temperature is maintained at the 185° F. normal operating temperature. When the engine temperature exceeds 265° F., temperature responsive material 31 will have expanded within receptacle 29 and displaced Teflon spacer 52, brass spacer 47, and piston 41 to the left into the second position or unsafe position, as indicated in FIG. 3.

In the second position, the O-ring 50 has been forced to disengage the annular seat 19 to provide direct communication from the fluid pressure inlet 37 to the fluid outlet port 39.

Since heat dissipating means 35 requires the presence of liquid coolant to transfer heat away from temperature sensing tip 27, the loss of a predetermined amount of liquid coolant will reduce the coolant level in coolant filled chamber 5 to a level below temperature sensing tip 27. When the coolant level falls to that point, heat dissipating means 35 will no longer dissipate heat from temperature sensing tip 27, so that the temperature of temperature sensing tip 27 will rapidly increase causing temperature responsive material 31 to expand and thereby displace piston 41 into the second position.

The provision of the intermediate bore portion 16 is an important feature of the present invention. Since the fluid pressure port 37 intersects the second bore section, there exists a possibility that rough edges or other machining imperfections will intrude into the bore. Thus, when the piston 41 is inserted into the bore during assembly, the O-ring 51 may be damaged with the result that the O-ring will either fail or will eventually leak, thereby permitting pressurized fluid from port 37 to contact spacer 47 and spacer 52. By providing the second bore section 17 with an intermediate bore portion 16 having a slightly larger diameter, the O-ring 51 can be inserted into the bore without contacting the edges formed by the intersection of the pressure port 37 and the bore section 17.

While temperature sensor valve 1 has been shown attached to the block of an engine, it is readily apparent that this apparatus can be used to sense the temperature and presence or absence of a liquid coolant in any engine-driven accessory, such as an air compressor, a transmission, or even the differential assembly of an engine drive train. Furthermore, it would be possible to use temperature sensor 1 in conjunction with a high volume engine driven water pump as might be included in a fire engine. Since this variety of water pump relies on the flow of water for cooling, the loss of a source of water for the pump would quickly activate temperature sensor valve 1 which is coupled to an engine protection means on the internal combustion engine which drives the water pump.

It is also possible to couple temperature sensor valve 1 to a source of pressurized fluid other than oil. It would be possible for temperature sensor valve 1 to decrease the pressure in a fluid system which would thereby activate a pressure sensitive switch which could disable an engine ignition system or shut off its source of fuel supply.

The gap between the forward edge of piston 41 and spacer 47 as shown in FIG. 2 will normally decrease in size at normal operating temperatures. Piston 41 will not be displaced to the left until an unsafe engine operating condition occurs.

It will be apparent to those skilled in the art that the disclosed temperature sensor valve may be modified in numerous other ways and may assume many other embodiments other than the preferred forms specifically set out and described above. Accordingly, it is intended by the appended claims to cover all such modifications of the invention which fall within the true spirit and scope of the invention.

What is claimed is:

1. In a liquid cooled engine or engine-driven accessory having engine protection means for reducing the engine RPM to a safe level in response to a fluid pressure below an acceptable level, a temperature sensor valve for continuously sensing the operating temperature of the engine or engine-driven accessory and the presence or absence of liquid coolant, the engine or engine-driven accessory including a housing and a coolant-filled chamber, and for reducing the fluid pressure below the acceptable level in response to an over-temperature condition or in response to at least a partial loss of the liquid coolant, said temperature sensor valve comprising in combination:

a. a body having a cylindrical bore;

b. a first radially inwardly extending annular seat dividing said bore into first and second sections;

c. said second section including an intermediate bore portion having a diameter larger than the diameter of the remainder of said section;

d. a fluid pressure port communicating with said intermediate bore portion for connection to a source of fluid under pressure;

e. a fluid outlet port communicating with said first bore section for providing a low pressure fluid drain;

f. temperature sensor means coupled to the housing and protruding into the coolant-filled chamber for receiving heat from the housing and for transferring heat into the coolant, said temperature sensor means including:

i. a temperature sensing tip having an internal, longitudinally extending receptacle; and ii. a temperature responsive material disposed within said receptacle for expanding and contracting in response to the temperature of said temperature sensing tip;

g. a piston slidably displaceable in said bore between a first position and a second position, said piston including:

i. a first large diameter element extending into said first bore section and having an O-ring for sealing engagement with said annular seat when said piston is in said first position, said O-ring out of engagement with said seat when said piston is in said second position;

ii. a second large diameter element extending into said second bore section and having an O-ring in continuous sealing engagement with said second bore section, said second large diameter element including a face in mechanical communication with said temperature responsive material;

iii. a reduced diameter portion extending between said first and second large diameter elements for substantially the length of said intermediate bore portion to provide fluid communication between said fluid pressure port and said first bore section;

h. biasing means for exerting a predetermined force on said piston to urge said piston into the first position;

whereby an engine over-temperature condition or loss of a predetermined amount of liquid coolant causes said temperature responsive material to expand and displace said piston from the first position to the second position for opening the path between said fluid pressure port and said fluid outlet port for reducing the fluid pressure below the acceptable level and thereby actuating the engine protection means to reduce the engine RPM to a safe level.

2. The apparatus of claim 1 wherein said temperature sensor means further includes:

a. heat receiving means coupled to the housing of said engine or engine-driven accessry for receiving heat therefrom; and b. heat dissipating means in contact with the liquid coolant for transferring heat from said temperature sensor means into the liquid coolant.

3. The apparatus of claim 1 wherein said temperature sensitive material includes a polyethylene material.

4. The apparatus of claim 1 wherein said temperature sensitive material includes bee's wax.

5. The apparatus of claim 1 including a spacer positioned between the face of said piston and one end of said temperature responsive material.

* * * * *